US010264342B2

(12) United States Patent
Huang et al.

(10) Patent No.: US 10,264,342 B2
(45) Date of Patent: Apr. 16, 2019

(54) OPEN HEADPHONE

(71) Applicant: Qingdao GoerTek Technology Co., Ltd., Qingdao (CN)

(72) Inventors: Meng Huang, Qingdao (CN); Xiuhua Duan, Qingdao (CN); Wenlai Zhang, Qingdao (CN)

(73) Assignee: Qingdao GoerTek Technology Co., Ltd., Qingdao (CN)

( * ) Notice: Subject to any disclaimer, the term of this patent is extended or adjusted under 35 U.S.C. 154(b) by 0 days.

(21) Appl. No.: 15/522,411

(22) PCT Filed: Dec. 16, 2015

(86) PCT No.: PCT/CN2015/097614
§ 371 (c)(1),
(2) Date: Apr. 27, 2017

(87) PCT Pub. No.: WO2016/101830
PCT Pub. Date: Jun. 30, 2016

(65) Prior Publication Data

US 2017/0353780 A1 Dec. 7, 2017

(30) Foreign Application Priority Data

Dec. 24, 2014 (CN) ..... 2014 1 0812531

(51) Int. Cl.
*H04R 1/10* (2006.01)
*H04R 1/28* (2006.01)
*H04R 5/033* (2006.01)

(52) U.S. Cl.
CPC ..... *H04R 1/1008* (2013.01); *H04R 1/10* (2013.01); *H04R 1/1058* (2013.01);
(Continued)

(58) Field of Classification Search
CPC ..... H04R 1/08; H04R 1/1008; H04R 1/1016; H04R 1/1058; H04R 1/2819;
(Continued)

(56) References Cited

U.S. PATENT DOCUMENTS 4,058,688 A * 11/1977 Nishimura ..... H04R 1/1008 381/354
4,160,135 A 7/1979 Gorike
(Continued)

FOREIGN PATENT DOCUMENTS

CN 1476275 A 2/2004
CN 2648750 Y 10/2004
(Continued)

OTHER PUBLICATIONS

International Search Report and Written Opinion dated Mar. 15, 2016 for PCT Application No. PCT/CN2015/097614.
(Continued)

*Primary Examiner* — Huyen D Le
(74) *Attorney, Agent, or Firm* — Moser Taboada

(57) ABSTRACT

Disclosed is an open headphone, comprising a front cover, a loudspeaker unit and a rear housing. A front headphone chamber is formed between the front cover and the loudspeaker unit. A rear headphone chamber is formed between the loudspeaker unit and the rear housing. The front cover is provided with several sound output holes. The loudspeaker unit has a middle loudspeaker hole which is through in a front-rear direction. The rear housing is also provided with a sound guide tube. The rear end of the sound guide tube is in communication with the external space of the headphone. The front end of the sound guide tube is inserted in the middle loudspeaker hole and at a distance from a vibrating diaphragm, and the distance is larger than a maximum vibration displacement of the vibrating diaphragm. The open
(Continued)

headphone of the present disclosure has high-quality bass performance, and other advantages, such as that the sound field is open and natural, that the user is not easy to become fatigue after long-term use, and that it will not cause damage to people's hearing. By inserting the front end of the sound guide tube in the middle loudspeaker hole, which is able to reduce the volume of the rear headphone chamber, so as to make the whole headphone small and easy to carry.

12 Claims, 3 Drawing Sheets

(52) U.S. Cl.
CPC ..... *H04R 1/2826* (2013.01); *H04R 1/2849* (2013.01); *H04R 5/033* (2013.01); *H04R 2201/10* (2013.01); *H04R 2460/11* (2013.01)

(58) Field of Classification Search
CPC .. H04R 1/2826; H04R 1/2842; H04R 1/2849; H04R 5/033; H04R 2460/11; H04R 2201/10
USPC ..... 381/309, 338, 345, 346, 348, 349, 370, 381/371, 372, 373, 380, 382; 181/129, 181/130, 160
See application file for complete search history.

(56) References Cited

U.S. PATENT DOCUMENTS 4,239,945 A * 12/1980 Atoji ..... H04R 1/2819 381/349
4,742,887 A * 5/1988 Yamagishi ..... H04R 1/2857 181/129
5,263,093 A * 11/1993 Nakamura ..... H04R 9/08 381/177
5,327,507 A * 7/1994 Suzuki ..... H04R 1/1016 381/345
5,844,998 A * 12/1998 Nageno ..... H04R 1/2842 381/371
6,934,401 B2 * 8/2005 Grell ..... H04R 1/1008 381/371
7,162,051 B2 * 1/2007 Grell ..... H04R 1/2842 381/370
9,883,280 B2 * 1/2018 Oosato ..... H04R 1/2826
2007/0195984 A1 8/2007 Yang

FOREIGN PATENT DOCUMENTS

CN 201426167 Y 3/2010
CN 104581483 A 4/2015
CN 204291318 U 4/2015
JP S62279996 A 12/1987
JP H02133090 U 11/1990
JP 4-103794 9/1992
WO WO 2013/114864 A1 8/2013

OTHER PUBLICATIONS

First Office Action for Application No. 201410812531.0.
Second Office Action for Application No. 201410812531.0.
European Search Report dated Nov. 24, 2017 for Application No. 15871898.1-1207.
Notice from European Patent Office pursuant to Article 94(3) dated Jan. 17, 2018 for Application No. 15871898.1.
Office Action for Application No. 2017-534335 dated Jul. 6, 2018.

* cited by examiner

OPEN HEADPHONE

FIELD OF THE DISCLOSURE

The present disclosure relates to an open headphone.

BACKGROUND OF THE DISCLOSURE

As science and technology develop and various audio and video playing products prevail, people have higher and higher requirements on sound quality, and correspondingly have higher and higher requirements on headphone quality. Specifically, in addition to requiring that headphones have high, medium and low clearly-layered and opera-like surrounding sound quality performance, people further hope that headphones do not cause fatigue and will not cause damage to people's hearing even though people use headphones for a long time period.

Currently, headphones are structurally classified roughly into two types: closed type and open type. The closed type headphone means employing a closed type sound chamber structural design, enclosing the sound emitted by a headphone loudspeaker unit in the space between the interior of the headphone housing and the wear's ears so that a person nearby cannot easily hear the sound produced by the headphone. The closed type headphone is advantageous in concentrating the sound produced by the headphone loudspeaker unit at the entrance of the ear canal and strengthening the bass effect, but disadvantageous in that the headphone sound is excessively concentrated at the center of the head and is not apt to create a feeling with surrounding sound, and meanwhile use for a long time period is likely to cause fatigue to the wearer and damage to the wearer's hearing. On the contrary, the open headphone causes the sound produced by the headphone loudspeaker unit to be locally heard by a nearby person, the sound is not concentrated at the center of the head, the sound field is open and natural, and use for a long time period is not apt to cause fatigue. However, the open type headphone cannot exhibit high-quality bass performance.

In the prior art, to make the open type headphones have high-quality bass performance, generally the space of a rear headphone chamber is enlarged or a loudspeaker unit with a large diameter is employed. That makes the overall size of the headphones larger and does not facilitate light-weighted and miniaturized design of headphones.

Therefore, it is desirable to design an open headphone integrating advantages of the closed type and open type headphones. The open headphone has high-quality bass performance, and other advantages, such as that the sound field is open and natural, that the user is not easy to become fatigue after long-term use, and that it will not cause damage to people's hearing. Furthermore, the whole headphone structure is light and small and easy to carry and use.

SUMMARY OF THE DISCLOSURE

The present disclosure provides an open headphone, which has especially high-quality bass performance, and other advantages, such as that the sound field is open and natural, that the user is not easy to become fatigue after long-term use, and that it will not cause damage to people's hearing, and is light and small and easy to carry and use.

To solve the above technical problem, the present disclosure employs the following technical solutions: an open headphone, comprising a front cover, a loudspeaker unit and a rear housing that are arranged from front to rear, wherein the front cover is provided with several sound output holes, a front headphone chamber is formed between the front cover and the loudspeaker unit, a rear headphone chamber is formed between the loudspeaker unit and the rear housing, the rear housing is provided with a wire lead-out aperture for leading out a loudspeaker wire, the loudspeaker unit has a magnet and a vibrating diaphragm located in front of the magnet, and a central position of the magnet is provided with a middle loudspeaker hole which is through in a front-rear direction, wherein the rear housing is further provided with a sound guide tube which is located in the interior of the headphone, a rear end of the sound guide tube is in communication with an external space of the headphone, a front end of the sound guide tube is inserted in the middle loudspeaker hole and at a certain distance from the vibrating diaphragm, and the distance is larger than a maximum vibration displacement of the vibrating diaphragm.

As compared with the prior art, the open headphone according to the present disclosure has advantages itself, such as that the sound field is open and natural, that the user is not easy to become fatigue after long-term use, and that it will not cause damage to people's hearing, and meanwhile, by arranging a sound guide tube on the rear housing of the headphone, the open headphone can transfer, in a centralized manner, back wave resulting from the action of the loudspeaker unit to the entrance of the ear canal to achieve an effect of compensating for bass and enable the open headphone to have high-quality bass performance. In addition, the sound guide tube has a certain length and tube diameter, which can discharge the back wave out of the wearer's ears quickly and in a suitable amount, function to balance the air stream and further improve the effect that the user is not easy to become fatigue after long-term use. Furthermore, since the front end of the sound guide tube is directly inserted in the middle hole of the loudspeaker unit, the size of the rear headphone chamber can be reduced, so that the whole headphone structure is light and small, and can be used as a portable earphone.

Other features and advantages of the present disclosure will be more apparent after reading the detailed description of the embodiments of the present disclosure with reference to the drawings.

BRIEF DESCRIPTION OF DRAWINGS

The drawings are used to provide further understanding of the present disclosure, and constitute part of the description. The drawings are used together with the embodiments of the present disclosure to illustrate the present disclosure and not intended to limit the present disclosure. In the drawings.

DETAILED DESCRIPTION OF PREFERRED EMBODIMENTS

Figure 1:
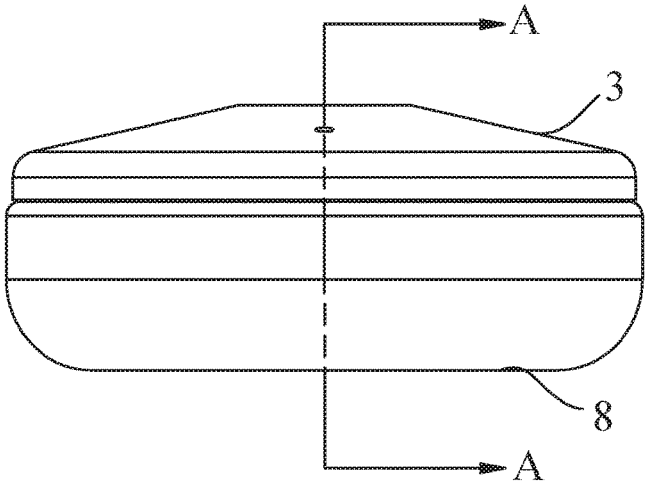
FIG. 1 is a structural schematic view of an open headphone according to an embodiment of the present disclosure.
Figure 2:
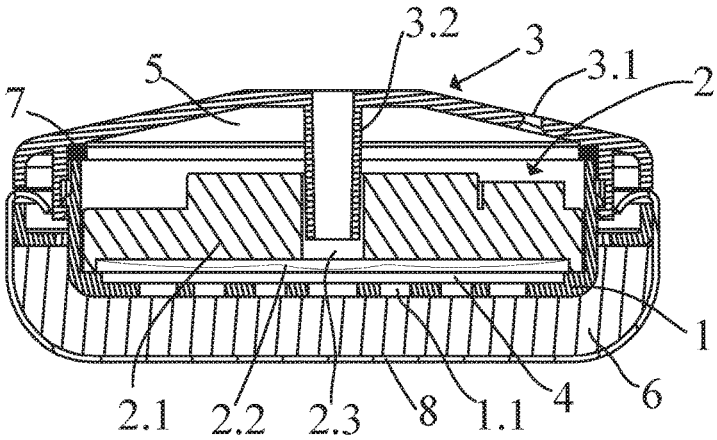
FIG. 2 is a sectional view taken along the line A-A of FIG. 1.
Figure 3:
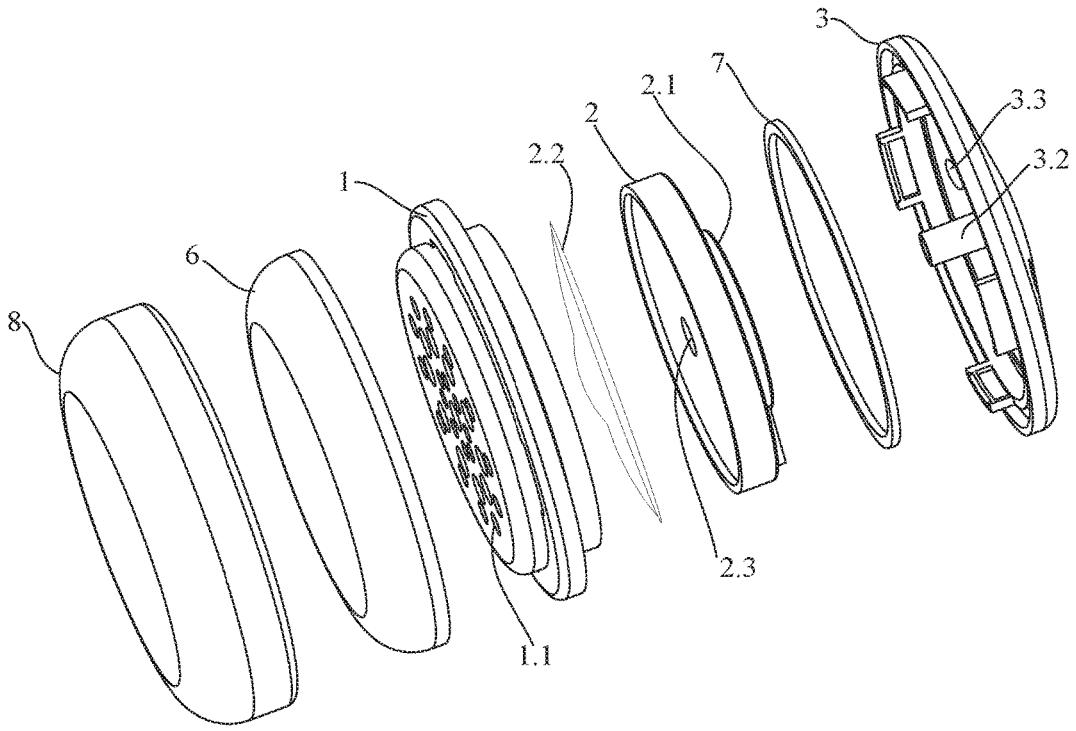
FIG. 3 is an exploded structural view of FIG. 1.
Figure 4:
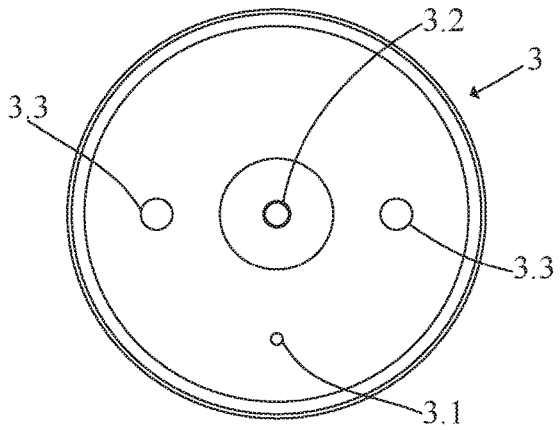
FIG. 4 is a structural schematic view of a rear housing of a headphone in an embodiment of the present disclosure.

Specific embodiments of the present disclosure will be further described in detail with reference to the drawings to make objectives, technical solutions and advantages of the present disclosure more apparent.

Referring to FIG. 1 through FIG. 4, an open headphone comprises a front cover 1, a loudspeaker unit 2 and a rear housing 3 that are arranged from front to rear. The front cover 1 is provided with several sound output holes 1.1 with an opening ratio of about 40%-60%. A front headphone chamber 4 is formed between the front cover 1 and the loudspeaker unit 2, and a rear headphone chamber 5 is formed between the loudspeaker unit 2 and the rear housing 3. Like the prior art, the rear housing 3 is connected with the loudspeaker unit 2 via a sealing ring 7, the front cover 1 is covered with a layer of damp-adjustable sponge 6, and the sponge 6 is encapsulated with a layer of soft fabric earcup 8, to protect the wearer's hearing and improve wearing comfort. The rear housing 3 is provided with a wire lead-out aperture 3.1 for leading out a loudspeaker wire. A sealing structure such as a sealant or a seal ring is disposed in the gap between the wire lead-out aperture 3.1 and the loudspeaker wire, to seal the wire lead-out aperture 3.1 and prevent sound from leaking. The loudspeaker unit 2 has a magnet 2.1 and a vibrating diaphragm 2.2 located at the front end of the magnet 2.1. The central position of the magnet 2.1 has a middle loudspeaker hole 2.3. The middle loudspeaker hole 2.3 is through the magnet 2.1 in the front-rear direction, i.e., its front end is in communication with a front loudspeaker chamber of the loudspeaker unit 2 (the front loudspeaker chamber here refers to the space that is in the interior of the loudspeaker, below the vibrating diaphragm, and defined by the vibrating diaphragm, a loudspeaker frame and the magnet), and its rear end is in communication with the rear headphone chamber 5. To improve the bass performance and effect of the open headphone, in the present embodiment the rear housing 3 is further provided with a sound guide tube 3.2. The sound guide tube 3.2 is located in the interior of the headphone, its rear end is in communication with the external space of the headphone, and its front end is inserted in the middle loudspeaker hole 2.3 and at a distance from the vibrating diaphragm 2.2. That is, the front end is located in the interior of the middle loudspeaker hole 2.3 and does not extend out of the middle loudspeaker hole 2.3, and meanwhile the distance should be larger than the maximum vibration displacement of the vibrating diaphragm 2.2, to prevent the front end of the sound guide tube 3.2 from touching the vibrating diaphragm 2.2 and causing damage to the vibrating diaphragm 2.2 when the vibrating diaphragm 2.2 arrives the maximum vibration displacement.

Figure 5:
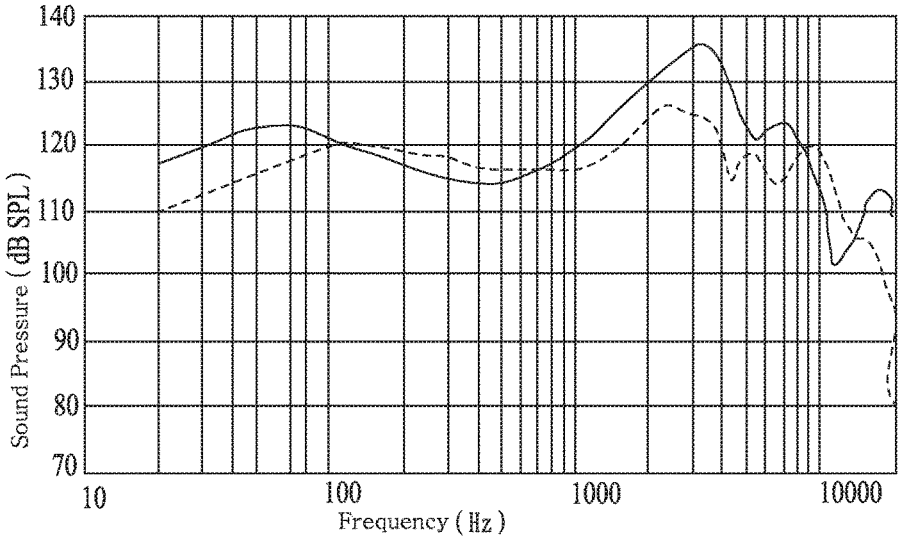
FIG. 5 is a comparison diagram of the actually-measured frequency response curve (as shown by the solid line) of the open headphone according to an embodiment of the present disclosure and the frequency response curve (as shown by the dotted line) of a conventional open headphone in the prior art.

When the open headphone according to the present embodiment is employed, the sound guide tube 3.2 is provided on the rear housing 3 to transfer, in a centralized manner, back wave resulting from the action of the loudspeaker unit 2 to the entrance of the ear canal to achieve an effect of compensating for bass and enable the open headphone to have high-quality bass performance FIG. 5 is a comparison diagram of the actually-measured frequency response curve (as shown by the solid line) of the open headphone according to an embodiment of the present disclosure and the frequency response curve (as shown by the dotted line) of a conventional open headphone in the prior art. As can be seen from FIG. 5, the open headphone according to the present embodiment has high-quality bass performance compared with the conventional open headphone in the prior art. In addition, the sound guide tube 3.2 has a certain length and tube diameter, which can discharge the back wave out of the wearer's ears quickly and in a suitable amount, function to balance the air stream and further improve the effect that the user is not easy to become fatigue after long-term use. Furthermore, since the front end of the sound guide tube 3.2 is directly inserted in the middle loudspeaker hole 2.3, the size of the rear headphone chamber 5 can be reduced, so that the whole headphone structure is light and small, can be used as a portable earphone, and avoids the problem about increased overall headphone size caused by increasing the space of the rear headphone chamber and using a loudspeaker unit with a large diameter to compensate for bass in the open headphone in the prior art.

For ease of processing, the rear end of the sound guide tube 3.2 is located at the central position of the rear housing 3, and arranged concentric with the middle loudspeaker hole 2.3. The sound guide tube 3.2 may be a straight tube or curved pipe, so long as it is ensured that its front end is inserted in the middle loudspeaker hole 2.3. Certainly, the sound guide tube 3.2 is preferably a straight tube, which can be easily processed and saves the space of the rear headphone chamber 5.

Specifically, the distance between the front end of the sound guide tube 3.2 and the vibrating diaphragm 2.2 is preferably 2 mm-4 mm.

Specifically, the diameter of the middle loudspeaker hole 2.3 is preferably 3 mm-8 mm, the outer diameter of the sound guide tube 3.2 may be preferably in a range of 2 mm-6 mm, and the length of the sound guide tube 3.2 may be 5 mm-20 mm.

Furthermore, the rear housing 3 is further provided with a sound tuning hole 3.3. The sound tuning hole 3.3 may be adhered with sound tuning materials with different damping properties such as sound tuning meshed fabric or sound tuning paper according to different requirements on sound quality. The sound tuning material covers the sound tuning hole 3.3 to improve the frequency response and the distortion levels of the headphone at some frequency bands. The diameter of the sound tuning hole 3.3 is preferably 4 mm-5 mm.

To facilitate processing and furthermore make the left and right headphones have the same frequency response, two sound tuning holes 3.3 are provided in the present embodiment, and arranged symmetrically with the center of the rear housing 3 as the base point.

The above embodiments are only used to illustrate the technical solutions of the present disclosure, and are not to limit the present disclosure. Although the present disclosure is described in detail with reference to the above embodiments, those skilled in the art may still modify the technical solutions recited in the above embodiments, or equivalently substitute part of the technical features of them. However, those modifications or substitutions do not make the essence of the corresponding technical solutions depart from the spirit and scope of the claimed technical solutions of the present disclosure.

What is claimed is:

1. An open headphone, comprising a front cover;

a loudspeaker unit; and a rear housing that are arranged from front to rear, wherein the front cover is provided with several sound output holes, a front headphone chamber is formed between the front cover and the loudspeaker unit, and the front headphone chamber is a space located inside the earphone that is constant and unchanged, a rear headphone chamber is formed between the loudspeaker unit and the rear housing, the rear housing is provided with a wire lead-out aperture for leading out a loudspeaker wire, the loudspeaker unit having a magnet and a vibrating diaphragm located in front of the magnet, and a central position of the magnet is provided with a middle loudspeaker hole which is through in a front-rear direction, a front end of the middle loudspeaker hole is in communication with a front loudspeaker chamber of the loudspeaker unit, and a rear end of the middle loudspeaker hole is in communication with the rear headphone chamber;

wherein the rear housing is further provided with a sound guide tube which is located in an interior of the headphone, a rear end of the sound guide tube is in communication with an external space of the headphone, a front end of the sound guide tube is inserted in the middle loudspeaker hole and does not extend out of the middle loudspeaker hole, and the front end of the sound guide tube tightly contacts with the inner wall of the middle loudspeaker hole, to transfer, in a centralized manner, back wave resulting from the action of the loud-speaker unit to the entrance of the ear canal, the sound guide tube is at a certain distance from the vibrating diaphragm, and the distance is larger than a maximum vibration displacement of the vibrating diaphragm.

2. The open headphone according to claim 1, wherein the rear end of the sound guide tube is located at a central position of the rear housing, and arranged concentric with the middle loudspeaker hole.

3. The open headphone according to claim 2, wherein the sound guide tube is a straight tube.

4. The open headphone according to claim 1, wherein the distance between the front end of the sound guide tube and the vibrating diaphragm is 2 mm-4 mm.

5. The open headphone according to claim 1, wherein a diameter of the middle loudspeaker hole is 3 mm-8 mm, an outer diameter of the sound guide tube is 2 mm-6 mm, and a length of the sound guide tube is 5 mm-20 mm.

6. The open headphone according to claim 5, wherein the rear housing is further provided with a sound tuning hole, and the sound tuning hole is covered with a sound tuning material.

7. The open headphone according to claim 6, wherein two sound tuning holes are provided and arranged symmetrically with a center of the rear housing as a base point.

8. The open headphone according to claim 6, wherein the sound tuning material is sound tuning meshed fabric or sound tuning paper.

9. The open headphone according to claim 6, wherein a diameter of the sound tuning hole is 4 mm-5 mm.

10. The open headphone according to claim 1, wherein a sealing structure is disposed in a gap between the wire lead-out aperture and the loudspeaker wire led out of the wire lead-out aperture.

11. The open headphone according to claim 1, wherein the front loudspeaker chamber is in the interior of the loudspeaker unit, and defined by at least the vibrating diaphragm and the magnet.

12. The open headphone according to claim 1, wherein the front loudspeaker chamber is defined by the vibrating diaphragm, the magnet and a frame of the loudspeaker unit.

* * * * *